United States Patent [19]

Allen

[11] Patent Number: 4,593,546

[45] Date of Patent: Jun. 10, 1986

[54] HIGH SECURITY CYLINDER OPERATED DEADBOLT LOCK

[76] Inventor: Mark L. Allen, 1776 E. 13th St., Brooklyn, N.Y. 11229

[21] Appl. No.: 685,222

[22] Filed: Dec. 26, 1984

Related U.S. Application Data

[63] Continuation of Ser. No. 419,808, Sep. 20, 1982, abandoned.

[51] Int. Cl.[4] ..... E05B 9/10

[52] U.S. Cl. ..... 70/380; 70/134; 70/370

[58] Field of Search ..... 70/379 R, 380, 129, 70/134, 451, 448, 449, 370, 189, 175, 375; 292/142

[56] References Cited

U.S. PATENT DOCUMENTS

| | | | |
|---|---|---|---|
| 1,125,791 | 1/1915 | Aston | 70/134 |
| 1,461,756 | 7/1923 | Croning | 70/451 X |
| 3,605,461 | 9/1971 | Frank | 70/380 X |
| 3,698,216 | 10/1972 | Keller-Volper | 70/380 |
| 3,808,854 | 5/1974 | Mercurio | 70/375 X |
| 3,992,908 | 11/1976 | Crepinser | 70/370 |
| 4,012,931 | 3/1977 | Harunari | 70/386 X |

FOREIGN PATENT DOCUMENTS

| | | | |
|---|---|---|---|
| 0022233 | 1/1981 | European Pat. Off. | 70/380 |
| 825218 | 12/1951 | Fed. Rep. of Germany | 70/370 |
| 1106637 | 5/1961 | Fed. Rep. of Germany | 70/134 |
| 1200331 | 12/1959 | France | 70/129 |
| 909652 | 10/1962 | United Kingdom | 70/134 |

*Primary Examiner*—Robert L. Wolfe
*Assistant Examiner*—Russell W. Illich
*Attorney, Agent, or Firm*—William P. Keegan

[57] ABSTRACT

A cylinder operated deadbolt lock in which a solid housing is provided with bores and apertures only to accommodate the lock components, such as the lock cylinder, the lock bolt, and the bolt moving mechanism. The lock bolt is provided with a rack and extends into the housing where it is thrown and withdrawn by a pinion mechanism.

1 Claim, 7 Drawing Figures

HIGH SECURITY CYLINDER OPERATED DEADBOLT LOCK

This is a continuation of application Ser. No. 419,808 filed Sept. 20, 1982, now abandoned.

FIELD OF THE INVENTION

This invention relates to deadbolt locks and more particularly to high security single and double cylinder operated deadbolt locks.

BACKGROUND OF THE INVENTION

While deadbolt locks have in the past adequately secured doors and the like against unauthorized entry, they are now being subjected to unprecedented abuse and assault. Cylinder operated locks have been provided with pick resistant cylinders, but picking the lock is not always the major problem to be guarded against. Rather, the lock mechanism, or more specifically the cylinder, is pried from its setting by a crowbar or similar tool. Escutcheons are often provided to encircle a lock cylinder to prevent a tool being inserted into the door adjacent the periphery of the cylinder and used to pry the cylinder out of the lock. In the absence of an escutcheon, this could be done because the cylinder is held in place by two machine screws which pass through a retaining plate on the opposite side of the door and into the back side of the cylinder, thus holding the cylinder against the front side of the door. When subjected to the force exerted by a crowbar, the screws simply fail in tension thus allowing the cylinder to pop out of the lock. With the cylinder removed, the bolt can easily be withdrawn from engagement with the door jamb.

BRIEF DESCRIPTION OF THE INVENTION

The object of the present invention is to provide an improved cylinder operated lock.

It is another object of the invention to provide a cylinder deadbolt lock that better resists violent removal of the cylinder from its setting.

It is yet another object of the invention to provide an improved deadbolt lock that has a high resistance to jimmying, bending, cutting, twisting, or other assaults on the integrity of the lock.

It is still another object of the invention to provide a cylinder operated deadbolt lock that is inexpensive to manufacture and easy for a locksmith to install.

In carrying out the invention, there is provided a lock housing that extends transversely through the door and which encompasses the lock operating cylinder or cylinders and the bolt moving mechanism of the lock. The bolt extends from within the housing through an aperture therein and through a bolt hole provided in the door.

More particularly, a cylindrical housing is provided to extend through the door and be secured in place by an internally threaded collar on the inside of the door. A collar is provided for the outside of the door and it, preferably, is freely rotatable with respect to the housing. A bolt extends through an aperture in the sidewall of the housing and a part of the bolt always remains in the housing when the bolt is extended into the door jamb. The bolt throwing and retracting mechanism is secured within the housing as is the key operated cylinder which enables the bolt to be actuated by a key from the outside of the door. A suitable mechanism, which may also be a key operated cylinder, is provided to actuate the bolt from the inside of the door. Apertures are provided in the housing only to accommodate the mentioned lock components.

A feature of the invention is that the lock structure prevents a crowbar or other prying tool from being worked into position behind the cylinder, as by gouging the doof adjacent the cylinder, so as to pry or pop the cylinder out of the door.

Another feature of the invention is that the lock structure, with the bolt projecting through the housing, prevents the lock from being twisted in the door.

Also, the lock resists jimmying or bending of the bolt since the bolt is never completely withdrawn from the housing. This enables a smaller diameter bolt to be used, and smaller holes to be drilled in the door and the door jamb to accommodate the bolt. This means that the door and the door jamb will be stronger, since less material is removed from both, thus improving the security provided by the lock.

Other features and advantages of the invention may be gained from the foregoing and from the description of a preferred embodiment thereof which follows.

DETAILED DESCRIPTION OF THE INVENTION

Figure 1:
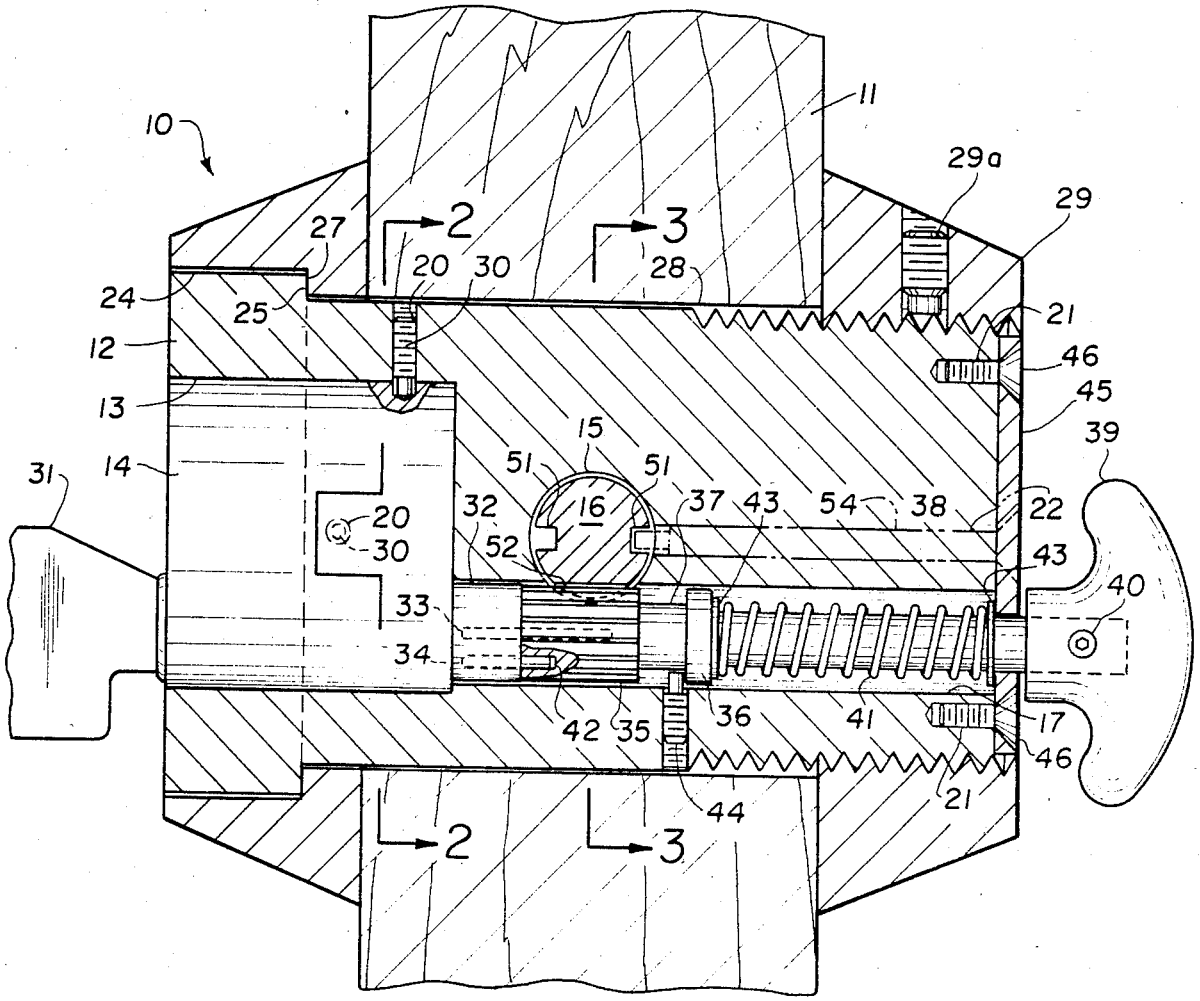
FIG. 1 is a side elevational view, partly in section, of a high security single cylinder lock according to the present invention.
Figure 2:
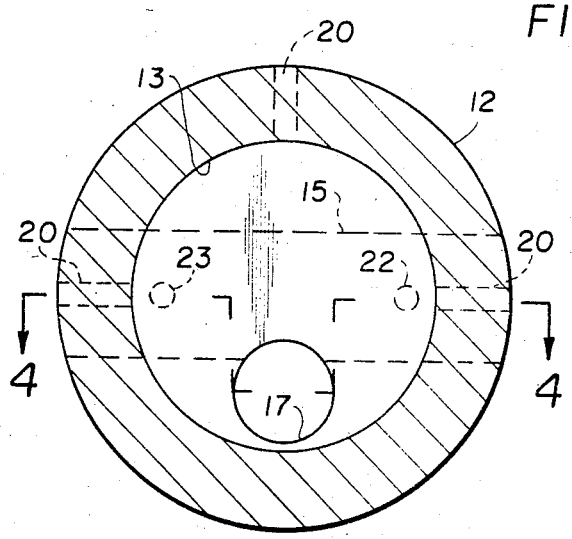
FIG. 2 is a sectional view of the lock housing taken along line 2—2 of FIG. 1.
Figure 3:
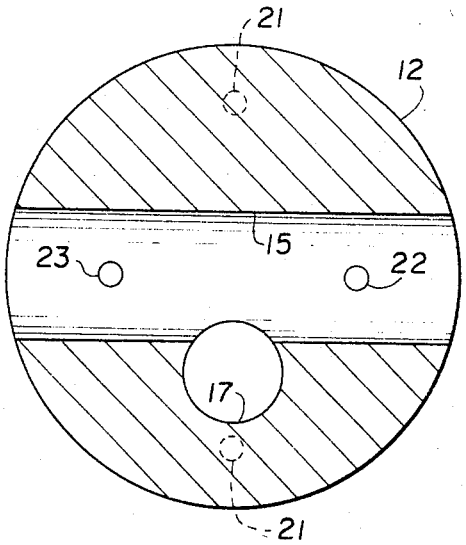
FIG. 3 is a sectional view of the lock housing taken along line 3—3 of FIG. 1.

Referring now to FIG. 1, the high security single cylinder lock 10 of the present invention is shown mounted in a door 11, which may be either a wooden door or a hollow metal door. Lock 10 comprises principally a cylindrical housing 12 machined from a solid bar of steel or other suitable material. As shown in FIGS. 2 and 3, housing 12 is provided with a plurality of cylindrical apertures or bores to accommodate various lock components as hereinafter described. Bore 13, which extends partway through the length of the housing will receive a lock cylinder 14, while transverse aperture 15 will form the setting for the locking bolt 16. A smaller diameter bore 17, extending from the bottom, i.e., the right end of bore 13 (FIG. 1), of bore 13 to the opposite face of the housing will have the bolt actuating mechanism placed therein. Set screws will be threaded into screwholes 20 to secure a lock cylinder in bore 13 of housing 12 while screwholes 21 will receive the screws for fastening an escutcheon plate to the inside end of housing 12. One of threaded screwholes 22 and 23, extending from the inside end of housing 12 to the locking bolt aperture 15, will have a guide screw placed therein to guide and limit the movement of the locking bolt. All of this will later be described, but the present intention is to emphasize that lock housing 12 is a solid piece of metal with the minimum amount of material removed therefrom, only that which is necessary to accommodate the lock components. The housing is further formed with a rim 24 that provides a substantial shoulder 25. The housing is also provided with external threads at the end remote from rim 24.

The arrangement for securing the housing 12 in a door will now be described, but it is to be understood that most of the lock components hereinafter described will be assembled in housing 12 before the housing is secured in a door. A collar 26 is formed with an annular shoulder 27 which cooperates with the shoulder 25 of rim 24 so that the outside faces of housing 12 and collar 26 will be coplanar. Collar 26, like housing 12, will be made of hardened steel or other suitable material. The housing 12 will be slipped through collar 26, as shown, and inserted in the door. On the inside of the door, a second collar 29, provided with internal threads, will be threaded onto housing 12 to draw collar 26 tightly against the outside of door 11. A set screw **29*a* will prevent collar 29 from being unscrewed from housing 12. It is noted that collar 26 is not secured to housing 12. Thus, anyone using a tool or wrench to grip the periphery of collar 26 with the intention of twisting or rotating housing 12 to break or bend the lock bolt would only be able to rotate the collar around housing 12**.

Referring again to FIG. 1, a lock cylinder 14 is secured within housing 12 by a plurality of set screws 30 threaded through holes 20 in housing 12 into apertures provided in cylinder 14. Some of holes 20 will be located in the plane of collar 26 and others in the plane of door 11. Cylinder 14, preferably a pick resistant cylinder, also may be protected by a guard plate threaded into an outer extension of housing 12 and secured therein by a screw passing through the cylinder. A key 31 is provided to rotate the cylinder pin 33 and an eccentrically mounted shorter pin 34. Pin 33 serves as a support for the bolt actuating pinion 35 which can rotate on pin 33 as well as slide axially thereon. Shorter pin 34 will engage pinion 35 when the lock is dormant, but it will be disengaged therefrom when the pinion is moved axially on pin 33 as hereinafter described.

Pinion 35 is integrally formed with a retainer member 36 having a peripheral groove 37 and an extension rod 38 which extends outwardly of lock 10 and to which a thumb turn 39 is secured as by set screw 40. A spring 41 positioned over rod 38 biases pinion 35 leftwardly as shown in FIG. 1 so that pin 33 is inserted in hole 42 provided in the end face of pinion 35. Washers 43 may be provided as bearing surfaces for the ends of spring 41. A set screw 44 projecting into groove 37 will limit the distance pinion 35 can move away from cylinder plug 32. The distance will be sufficient, however, to disengage pin 34 from pinion 35.

On the inside end of housing 12, an escutcheon 45 is provided. It is secured to the housing by countersunk screws 46 threaded into screwholes 21.

Figure 4:
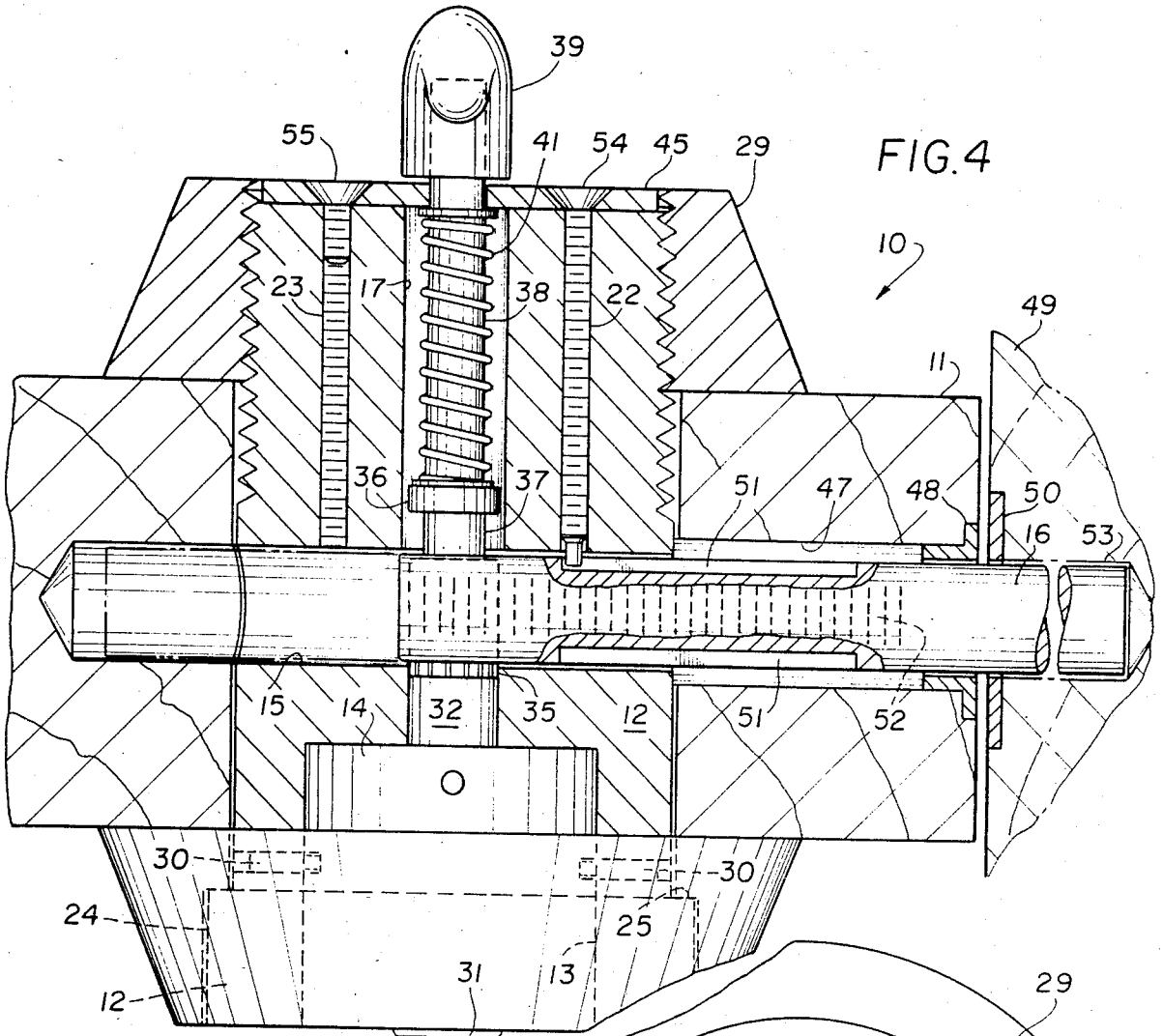
FIG. 4 is a top plan view, partly in section taken along line 4—4 of FIG. 2, of the lock shown in FIG. 1.
Figure 5:
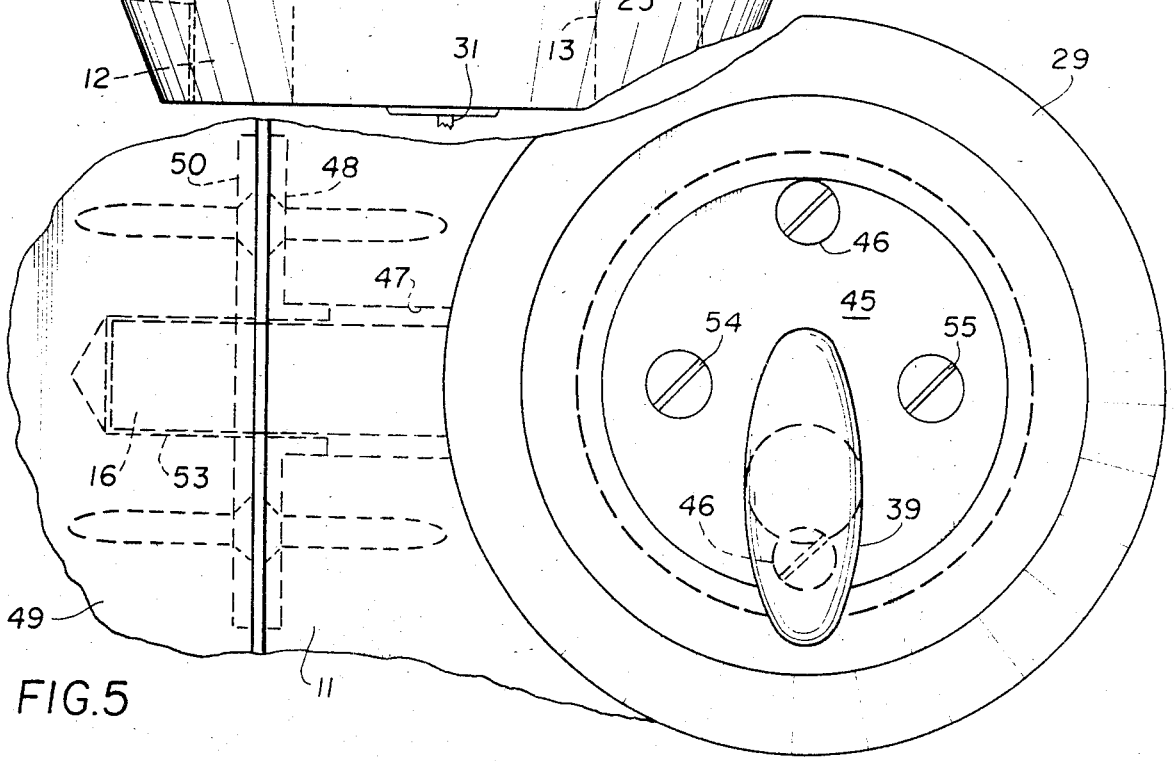
FIG. 5 is a rear elevational view, i.e., looking at the inside of the door, partly in section, showing the bolt in its locking position.

Referring now to FIG. 4, lock 19 is shown with bolt 16 in locking position. In this position, bolt 16 extends from inside housing 12 through aperture 15 provided in the sidewall of the housing, through hole 46 drilled in door 11 and faceplate 48 mounted on the edge of the door, into door jamb 50. The bolt is preferably a hardened steel cylindrical rod provided with guide grooves 51 on each side thereof. The underside of bolt 16 is formed with a rack 52 so that it may engage with and be moved by pinion 35.

Lock 10 is assembled as follows. Cylinder 14 is secured in housing 12 as by set screws 30. Pinion 35 is engaged with pins 33 and 34 and spring 41 is placed over rod 38. Escutcheon 45 is fitted on rod 38 and secured to housing 12 by screws 46. Set screw 44 is threaded through housing 12 until it projects into groove 37 of member 36.

To install lock 10 in a door, first hole 28 is drilled through door 11 to accommodate housing 12. Then hole 47 is drilled to accommodate bolt 16. A similar, but shallower, hole 53 is drilled in door jamb 49 to receive the extended bolt. Next, collar 26 is slipped over housing 12 and the housing inserted through hole 28. Collar 29 is then threaded onto housing 12 to secure the assembled lock in door 11. Then, bolt 16 is inserted, from the edge of door 11, into hole 47 and through aperture 15 in housing 12 until it engages pinion 35. At this time, pinion 35 is disengaged from pin 34 as by pulling thumb turn 39 to the right, as viewed in FIG. 1, so that the pinion may turn freely on pin 33. When the end of bolt 16 is flush with faceplate 48, pinion 35 will be positioned such that hole 42 will be aligned with pin 34. Thumb 39 may then be released so that spring 41 causes pinion 35 to move axially and engage pin 34. Guide screw 54 will then be treated through screwhole 22 until it projects into groove 51 formed in the side of bolt 16. The screw, 54, at this time, will contact the left hand end of groove 51 (FIG. 4) and so limit the extent of withdrawal of bolt 16 into door 11. At the same time, it is assured that pinion 35 is positioned with hole 42 aligned with pin 34 of cylinder plug 32. A short screw 55 is threaded into second screwhold 23 to give a finished appearance to escutcheon 45. The second screwhole 23 is provided so that the lock 10 can be installed in an opposite handed door in which the bolt would project to the left (FIG. 4) instead of to the right as shown. In such case, guide screw 54 would be threaded through the leftward screwhole 23 and it would engage the groove 51 on the opposite side of bolt 16. Thumb turn 39 is then fastened to rod 38 as by set screw 40, thus completing the installation of the lock.

In operation, the lock would normally be in the position as shown in FIG. 1 with pinion 35 engaging pin 34. This is so whether the bolt 16 is fully extended, as in FIG. 4, or withdrawn with the leading end of the bolt flush with faceplate 48. To actuate the bolt from the outside of the door, either to extend or to withdraw the bolt from its locking position, key 31 is inserted in cylinder 14 and rotated one complete revolution in the appropriate direction, Cylinder plug 32 rotates and pin 34 drives pinion 35 to move bolt 16. The inside thumb turn 39 will also rotate when cylinder plug 32 is rotated by key 31, but this has no adverse effect. When the bolt is extended into door jamb 49 and pinion 35 is engaged by pin 34, the bolt will be deadlocked when key 31 is removed from cylinder 14. To actuate the bolt from inside the door, as by turning thumb turn 39, pinion 35 must be disengaged from pin 34 as by pulling thumb turn 39 against the bias of spring 41. When so disengaged, the thumb turn can be rotated to extend or withdraw the bolt. At the end of one complete rotation of thumb turn 39, the thumb turn is released and spring 41 causes pinion 35 to engage pin 34. Thus, the various parts of the lock are in position for subsequent actuation either by key 31 or thumb turn 39.

Figure 6:
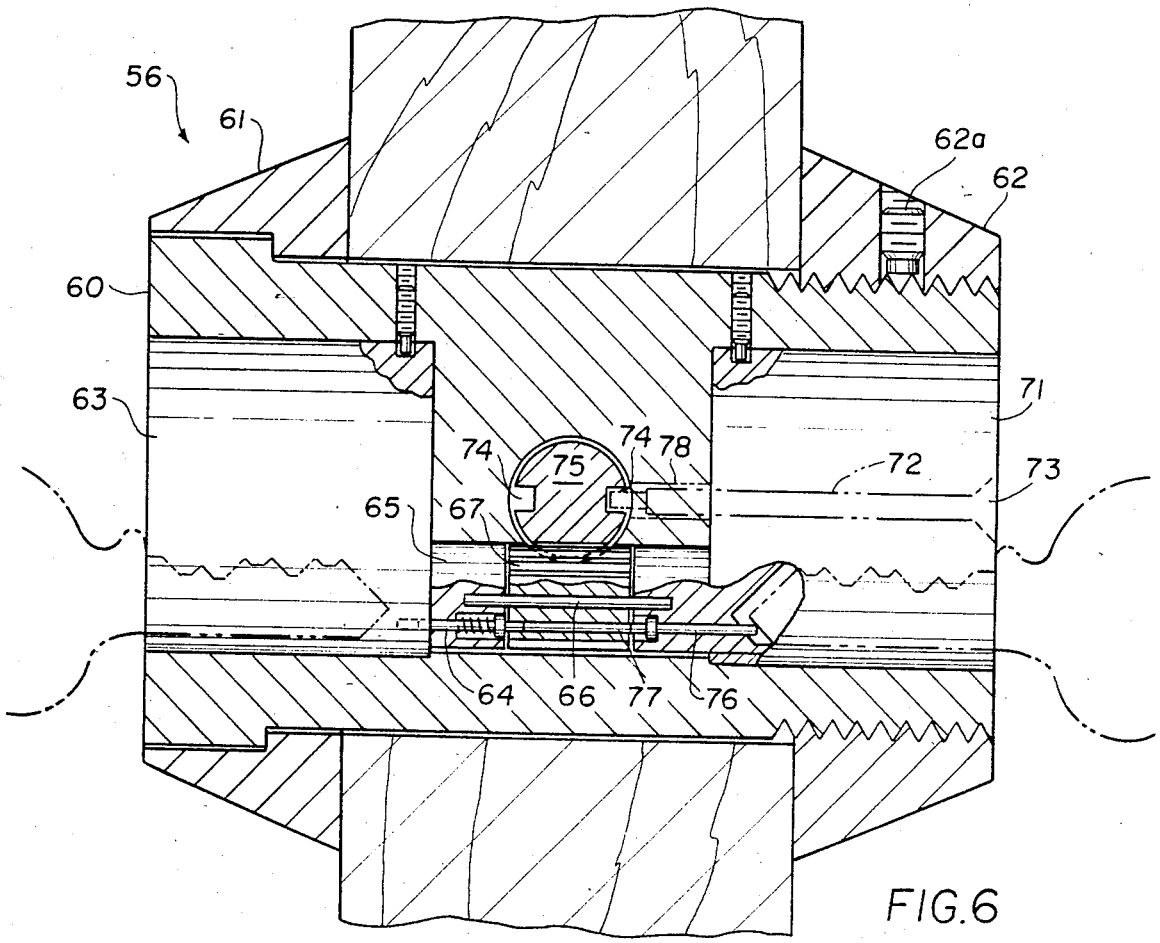
FIG. 6 is a side elevational view similar to FIG. 1, but showing a double cylinder lock.

Attention is now directed to FIG. 6 which shows a high security double cylinder lock 56 which is key actuated from both outside and inside the door. Except for the use of a cylinder, instead of a thumb turn, provided for the inside of the door, and a different pinion engaging mechanism, the double cylinder lock is similar to the single cylinder lock just described. The lock housing 60 is similar to housing 12 except that the bores therein are different so as to accommodate an inner lock cylinder, while collars 61 and 62 are the same as for the FIG. 1 embodiment. The parts are assembled as previously described. Cylinder 63 is similar to cylinder 14, except that pin 64 is not fixed in cylinder plug 65 as pin 34 is in plug 32. Cylinder 63 is secured in housing 60 by set screws as is cylinder 14. Cylinder plug 65 is provided with a support pin 66 upon which pinion 67 freely rotates. As is seen more clearly in FIG. 7, support pin 66 passes through pinion 67 to cylinder plug 70 of cylinder 71. This latter cylinder is similar to cylinder 63 and is secured within housing 60 by set screws. However, cylinder 71 is provided with threaded screwholes 72 on opposite sides thereof. Apertures 78, slightly larger than and aligned with screwholes 72, are provided in housing 60. These screwholes and apertures permit a guide screw 73 to enter groove 74 of bolt 75 for the same purposes that guide screw 54 engaged bolt 16.

Figure 7:
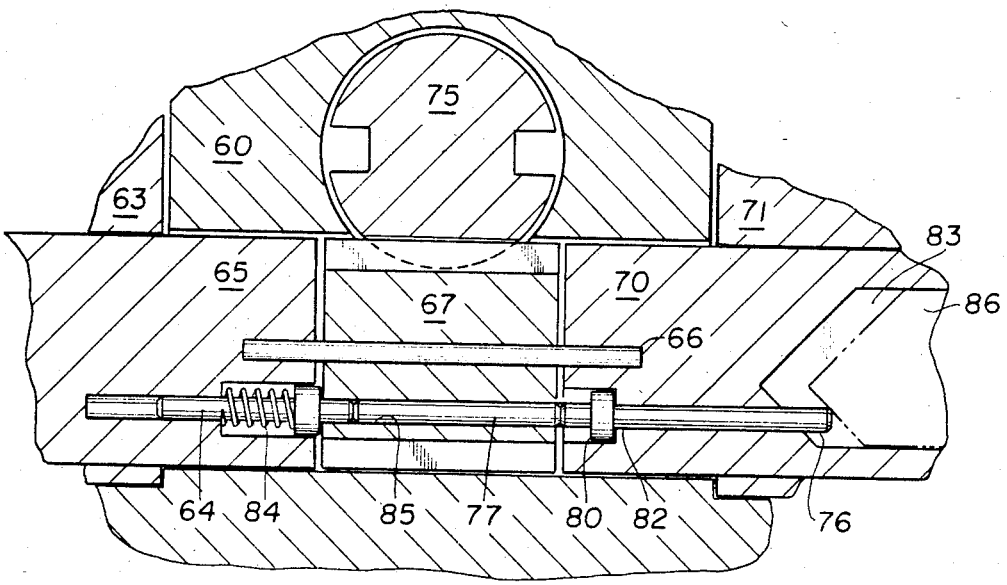
FIG. 7 is a detailed view of the bolt actuating mechanism of the double cylinder lock of FIG. 6.

Attention is now directed to FIG. 7 where the bolt moving mechanism is shown in enlarged detail. Pinion 67 is shown closely fitted between cylinder plugs 65 and 70. As noted above, pinion 67 is free to rotate on pin 66 which is supported by the two cylinder plugs 65 and 70. The pinion rotating mechanism comprises pin 64 which is eccentrically mounted in cylinder plug 65 and pin 76 eccentrically positioned in cylinder plug 70. Aligned with pins 64 and 76 is pinion sliding pin 77.

Pin 76 is formed with a rim 80 which engages shoulder 81 formed in pin slot 82 to limit rightward movement (FIG. 7) of pin 76. With its position thus determined, the end of pin 76 proximate to rim 80 is flush with the end of cylinder plug 70 and its distal end projects into the keyway 83. Pinion sliding pin 77 abuts the proximate end of pin 76. The other end of sliding pin 77, which pin is shorter than the width of pinion 67, is engaged by the end of pin 64. Pin 64 is, as shown, urged rightwardly by spring 84 so that it extends into pin aperture 85 of pinion 67. The arrangement is such that spring loaded pin 64 slides pin 77 rightwardly against pin 76 until movement of all three pins is arrested by the engagement of rim 80 and shoulder 81.

Since pin 64 engages pinion 67, and pin 76 is out of engagement with pinion 67, rotation of cylinder plug 65 by a key will cause rotation of pinion 67 and actuation of bolt 75. To actuate the bolt by rotation of the inside cylinder plug 70, key 86 is inserted in keyway 83. As the key is pushed all the way into the keyway, the leading end of the key engages the end of pin 76 and pushes it leftwardly (FIG. 7). Thus, the end of pin 76 engages pinion 67 and, while doing so, pushes pin 77 to the left to disengage pin 64 from the pinion. Now, when plug 70 is rotated by key 86, pin 76 will cause pinion 67 to rotate and drive bolt 75. When key 86 is removed from plug 70, the pins 64, 77, and 76 will return to the positions shown in FIG. 7 under the influences of spring 84. Since pin 64 will normally be in engagement with pinion 67, bolt 75 will be effectively deadlocked when in its locked position.

Having thus described the invention, it is to be understood that many apparently different embodiments thereof can be made without departing from the spirit and scope of the invention. For example, different cylinders such as small diameter or wafer tumbler cylinders could be used, as could different bolt driving mechanisms such as a cam drive. Screwholes 72 could be provided in housing 60 instead of in cylinder 71. In any case, the lock housing will be drilled only to accommodate the parts provided, thus assuring maximum lock strength. Therefore, it is intended that the foregoing specification and the accompanying drawing be interpreted as illustrative rather than in a limiting sense.

What is claimed is:

1. A high security door lock comprising: a lock housing consisting of a solid cylindrical member having an outwardly projecting rim at one end thereof, said rim providing an external shoulder spaced from said one end, the other end of said cylindrical member being threaded so that a flange means can be threaded onto said cylindrical member, said cylindrical member being provided at said one end with an axial bore having a depth substantially equal to the longitudinal length of a lock cylinder, a second longitudinal bore extending from the bottom of said axial bore to said other end of said cylindrical member, said second bore including a small diameter section and a larger diameter axial section having a depth substantially equal to the longitudinal length of a lock cylinder, a bolt receiving bore intersecting said small diameter section of said second bore and extending transversely through said cylindrical member so that a bolt can be inserted therein from either side of said cylindrical member; bolt driving pinion means rotatably mounted in said small diameter section of said second bore, said pinion means being provided with an eccentrically positioned bore extending longitudinally through said pinion means; lock cylinder means positioned in said first bore so as to be substantially flush with said one end of said cylindrical member and to substantially fill said first bore, said lock cylinder means being provided with a bolt moving member extending into said small diameter section of said second bore and including eccentrically mounted pin means slidably biased into driving engagement with said pinion means; a solid bolt slidably positioned in said bolt receiving bore and provided with a rack section that engages said pinion means, said bolt when driven to a locking positon remaining in engagement with said bolt driving pinion means and in said bolt receiving bore so as to prevent said cylindrical member being rotated in a door in which it is installed; second lock cylinder means positioned in said larger diameter section of said second bore so as to substantially fill said larger diameter section and to be substantially flush with said other end of said cylindrical member, said second lock cylinder means being provided with a bolt moving member extending into said small diameter section of said second bore and including eccentric pin means slidably mounted for movement into and out of driving engagement with said pinion means; connecting pin means slidably positioned in said eccentrically positioned bore in said pinion means and aligned with the eccentrically mounted pins of the bolt moving members of said lock cylinders, the arrangement being such that said biased pin of said lock cylinder causes said connecting pin means to push said eccentrically mounted pin of said second lock cylinder means out of driving engagement with said pinion means, the arrangement being further such that the eccentrically mounted pin of said second lock cylinder means can be moved by a key inserted into said second lock cylinder means into driving engagement with said pinion means, such movement causing said connecting pin means to push biased eccentrically mounted pin of said lock cylinder means out of driving engagement with said pinion means; an annular collar member having an internal shoulder and adapted to slide over said cylindrical member so that when the shoulder of said collar member abuts the shoulder of said cylindrical member the end of said collar member is flush with said one end of said cylindrical member and can rotate freely thereon; and flange means threaded onto the threaded end of said cylindrical member to engage the inner side of a door in which the lock is installed.

* * * * *